US009049898B2

(12) United States Patent
Donnadieu

(10) Patent No.: US 9,049,898 B2
(45) Date of Patent: Jun. 9, 2015

(54) FOOTWEAR WITH IMPROVED UPPER

(71) Applicant: SALOMON S.A.S., Metz-Tessy (FR)

(72) Inventor: Thierry Donnadieu, Sillingy (FR)

(73) Assignee: SALOMON S.A.S., Metz-Tessy (FR)

( * ) Notice: Subject to any disclaimer, the term of this patent is extended or adjusted under 35 U.S.C. 154(b) by 267 days.

(21) Appl. No.: 13/630,879

(22) Filed: Sep. 28, 2012

(65) Prior Publication Data

US 2013/0091737 A1 Apr. 18, 2013

(30) Foreign Application Priority Data

Oct. 12, 2011 (FR) ..... 11.03100

(51) Int. Cl.

| | |
|---|---|
| ***A43C 11/00*** | (2006.01) |
| ***A43B 5/04*** | (2006.01) |
| ***A43B 1/00*** | (2006.01) |
| ***A43B 3/00*** | (2006.01) |
| ***A43C 7/02*** | (2006.01) |

(52) U.S. Cl.

CPC ..... *A43B 5/0411* (2013.01); *A43C 11/00* (2013.01); *A43B 5/04* (2013.01); *A43B 1/0081* (2013.01); *A43B 3/0031* (2013.01); *A43C 7/02* (2013.01)

(58) Field of Classification Search

CPC ..... A43B 5/04; A43C 11/00
USPC ..... 36/50.1, 50.5, 136
See application file for complete search history.

(56) References Cited

U.S. PATENT DOCUMENTS

| | | | | |
|---|---|---|---|---|
| 5,477,593 | A | 12/1995 | Leick | |
| 5,566,474 | A * | 10/1996 | Leick et al. | 36/50.1 |
| 6,532,688 | B2 * | 3/2003 | Bouvier | 36/50.1 |
| 7,401,423 | B2 * | 7/2008 | Reagan et al. | 36/50.1 |
| 7,650,705 | B2 * | 1/2010 | Donnadieu et al. | 36/50.5 |
| 2002/0002781 | A1 * | 1/2002 | Bouvier | 36/50.1 |
| 2009/0100717 | A1 * | 4/2009 | Cabanis | 36/116 |
| 2009/0119952 | A1 * | 5/2009 | Chovino et al. | 36/118.1 |
| 2011/0030244 | A1 * | 2/2011 | Motawi et al. | 36/117.1 |
| 2011/0088283 | A1 * | 4/2011 | Berthet et al. | 36/50.1 |

FOREIGN PATENT DOCUMENTS

| | | | |
|---|---|---|---|
| EP | 0 629 793 | A1 | 12/1994 |
| EP | 1 917 873 | A2 | 5/2008 |
| EP | 2 052 636 | A1 | 4/2009 |

* cited by examiner

*Primary Examiner* — Marie Bays
(74) *Attorney, Agent, or Firm* — Greenblum & Bernstein, P.L.C.

(57) ABSTRACT

An article of footwear, such as a boot, including an outer sole assembly and an upper, the boot extending lengthwise from a rear end to a front end, widthwise between a lateral side and a medial side, and heightwise from the outer sole assembly to an upper end of the upper, the upper including a lateral quarter and a medial quarter, the boot including a first tightening device, which itself includes a linkage and a quick-locking device, the boot including a cover flap. The flap demarcates a storage space capable of receiving the quick-locking device.

23 Claims, 4 Drawing Sheets

FOOTWEAR WITH IMPROVED UPPER

CROSS-REFERENCE TO RELATED APPLICATION

This application is based upon French Patent Application No. 11/03100, filed Oct. 12, 2011, the disclosure of which is hereby incorporated by reference thereto in its entirety, and the priority of which is claimed under 35 U.S.C. §119.

BACKGROUND

1. Field of the Invention

The invention relates to an article of footwear, especially a sports boot, and relates more particularly to a boot adapted for skiing, power walking, and other sporting activities.

A boot of the aforementioned type can be used in fields such as cross-country skiing or telemark skiing, walking or running on flat or mountainous terrain, hiking, snowboarding, snowshoeing, roller skating, skateboarding, cycling, ball sports, or the like.

2. Background Information

A boot can have a low upper or a high upper. In either case, it is generally desirable for the foot of a user to be adequately supported. Indeed, good foot support in the upper results in a more efficient use of the boot, particularly in the fields of endeavor cited above.

For example, adequate support in a flexible boot, such as that in a boot used in cross-country skiing, facilitates the transmission of sensory information and the rolling movement of the foot during use. A device for tightening the upper is adapted to support the user's foot, especially in the area of the instep.

Conventionally, a tightening device includes a linkage, such as a lace, on the one hand, and guides for connecting the lace to the upper. These guides or connections are defined by keepers, e.g., that are associated with lateral and medial portions or quarters of the upper. The lace follows a path along which it runs alternately from one quarter to the other. Thus, it suffices to pull on the lace to bring the quarters in a direction toward one another to tighten the upper. Thereafter, locking the lace keeps the upper tightened. It is known to employ a reversible locking mechanism, which offers advantages such as ease and speed of tightening and releasing of tension on the lace.

It is also desirable for the foot of the user to be protected from potential risks of intrusion of foreign matter, such as water or snow, into the boot. To this end, it is known to use a cover flap, i.e., a flap adapted for at least partially concealing an opening for inserting the foot in the boot, in the area of the tightening device. Thus, the flap is adapted to cover the lace, the quick-locking mechanism, and areas of the quarters of the upper. This arrangement provides the user with good conditions of use, as the foot is properly held in the boot and is protected from intrusions.

However, it has been shown that the aforementioned conditions of use, although good, could be further improved. Indeed, a user sometimes feels discomfort associated with foot movements in relation to the lower leg. For example, the flap adversely affects the freedom of movement during bending, i.e., when the leg tilts in a direction towards the foot. The flap, although otherwise very useful, also restricts certain movements of the foot in relation to the leg during bending or during certain rotations. In fact, folds can form in the area of the flap, which stiffen the flap and negatively affect its flexibility. In other words, the flap does not adequately conform to the shape of the foot and, as a result, it is the flexibility of the upper, broadly speaking, that is adversely affected. Therefore, the freedom of movement of the foot is adversely affected.

SUMMARY

In view of the foregoing, the invention generally improves the upper of a boot. More specifically, the invention reduces, or even eliminates, the discomfort caused by a covering flap of a boot provided with a tightening device having a quick-locking mechanism for a drawstring. In other words, the present invention improves comfort in the boot.

Furthermore, the invention improves the use and advantages of the tightening device, despite the presence of such a flap.

To this end, the invention provides a boot, or article of footwear, which includes an outer sole assembly and an upper, the boot extending lengthwise from a heel to a front end, widthwise between a lateral portion and a medial portion, and heightwise from the outer sole assembly to an upper end of the upper, the upper including a lateral quarter and a medial quarter, the boot including a first tightening device which itself includes a linkage and a quick locking mechanism, the boot further including a cover flap.

The flap of the boot according to the invention demarcates a storage space capable of receiving the quick-locking mechanism. For example, the flap of the boot according to the invention has a first opening, the quick-locking mechanism being positioned in the area of the first opening of the flap when the tightening device tightens the linkage, and the panel is arranged in the area of the first opening, in order to close the latter by enveloping the locking mechanism. Thus, the panel demarcates the storage volume for the locking mechanism.

The panel demarcates a storage pocket for the locking mechanism in the area of the opening of the flap. Because it covers the mechanism, the pocket provides a storage volume projecting on the outer side of the flap. As a result, the flap retains its natural shape when it is applied on the remainder of the upper, opposite the tightening device. Consequently, it can be said that, contrary to what happens with a boot according to the prior art, the locking mechanism here does not create a local deformation of the flap in an outwardly projecting direction. Therefore, the flap on the boot of the invention is capable of conforming to the curves of the upper, in the area of the tightening device and in the area of the quarters. In other words, the flap does not form, or only slightly forms, folds when applied on the remainder of the upper, at least when the leg is not bent. As a result, the reversible deformations of the flap, which are defined by folding, are mainly due to the bending of the leg in relation to the foot. Indeed, bending can cause a portion of the flap to fold. But this folded state is minimal, because the flap curvatures are uniform prior to the folding. This is not a case in which the folding resulting from bending, or from another movement, adds to an initial deformation due to a projection created by the locking mechanism, as is the case in the prior art.

Thus, an advantage resulting from the invention is greater freedom of movement of the foot in relation to the leg. In particular, the bending movements are not hampered, or are only slightly hampered.

As will be further understood from the following description, the boot according to the invention improves the implementation of the tightening device, despite the boot having a covering flap.

BRIEF DESCRIPTION OF DRAWINGS

Other characteristics and advantages of the invention will be better understood from the description which follows, with reference to the annexed drawing illustrating, by way of non-limiting embodiments, how the invention can be embodied, and in which.

DETAILED DESCRIPTION

The first embodiment described below relates more specifically to boots adapted for the practice cross-country skiing or telemark skiing. However, the invention is applicable to boots and footwear of other types, including that of fields of endeavor mentioned above.

The first embodiment is described below with reference FIGS. 1 to 3.

Figure 1:
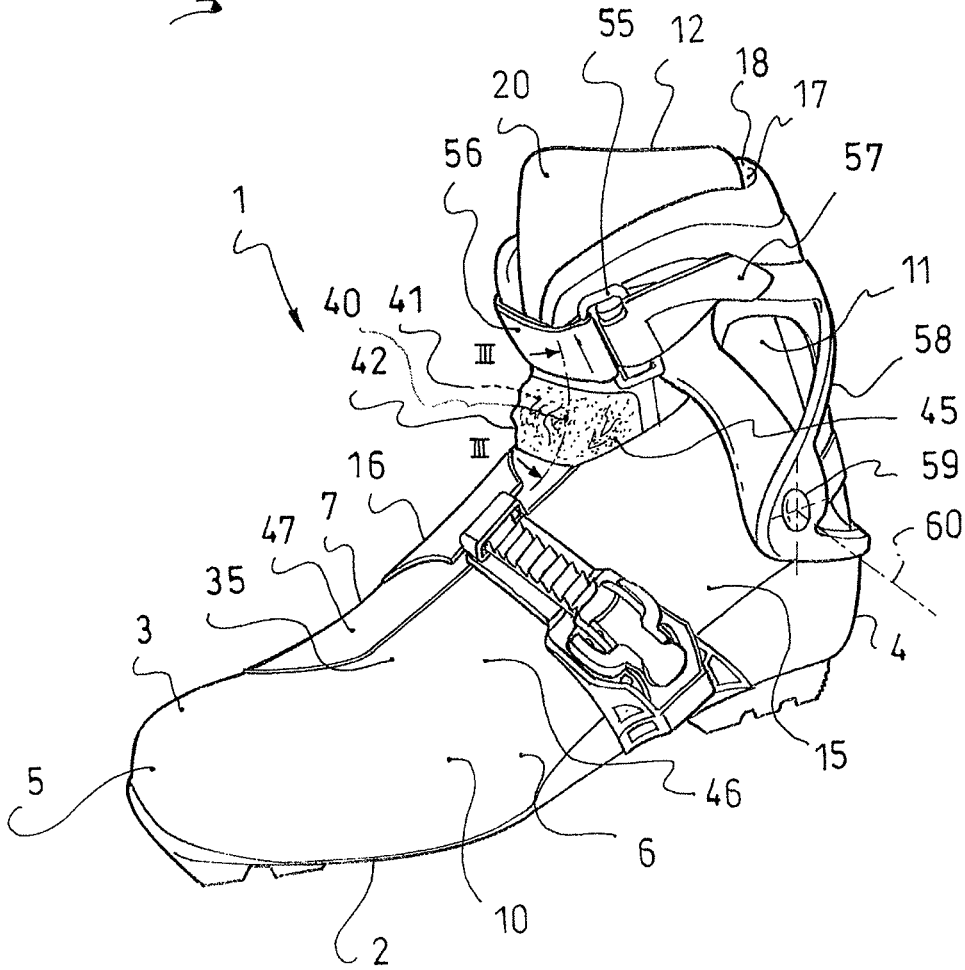
FIG. 1 is a perspective front view of a boot according to a first embodiment of the invention, in a case in which the flap is applied on the remainder of the upper in a use configuration of the boot.

As shown in FIG. 1, a cross-country ski boot 1 is adapted to receive the foot of a user.

As is known, the boot 1 includes an outer sole assembly 2 and an upper 3. The boot 1 extends lengthwise from a rear end, or heel 4, to a front end, or tip 5, and widthwise between a lateral portion 6 and a medial portion 7.

As shown, the upper 3 includes a first portion or lower portion 10, provided to surround the foot, and a second portion or top portion 11, provided to surround the ankle. However, an upper could be provided to include only the lower portion.

According to the first illustrated embodiment, the boot 1 extends heightwise from the outer sole assembly 2 to an upper end 12, i.e., up to the free end of the top portion 11 or of the upper 3.

The boot 1 is structured so as to enable proper bending of the leg and a good rolling movement of the foot, as well as the transmission of sensory information and steering impulses. Therefore, the upper 3 is relatively flexible. The outer sole assembly can be relatively rigid, or it can be much more flexible.

The boot 1, in fact the upper 3, includes a lateral quarter 15 and a medial quarter 16. The quarters 15, 16 are adapted to cover the foot and, as such, are the constituent elements of the lateral portion 6 and medial portion 7, respectively.

The quarters 15, 16 are affixed to the sole by means of known techniques, such as an adhesive, stitching, or any other equivalent technique. The quarters 15, 16 are arranged so that the boot 1 has an opening 17 for foot insertion. As shown more clearly in FIG. 2, the opening 17 extends from the upper end 12 to the front end 5. On the side of the upper end 12, the opening 17 has an upper subdivision 18 constructed to allow the foot to pass through, and also to surround the ankle after the foot has been inserted. The opening 17 has a lower subdivision 19 which enables the size of the opening and the size of the fitting volume to vary, in the area of the instep, between the upper end 12 and the front end 5. The upper 18 and lower 19 subdivisions are co-extensive with one another.

The heel 4 corresponds to the rear end of the upper 3, but also, by extension, to the portion of the upper that is located immediately above the outer sole assembly, and is plumb with the upper subdivision 18 of the opening top 17. The heel 4 of the boot envelops the heel of the user.

The upper 3 includes a tongue 20, which is arranged between the lateral quarter 15 and the medial quarter 16, in the area of the lower subdivision 19 of the opening 17, in order to provide the upper 3 with continuity. However, the tongue could be omitted, in which case, the quarters 15, 16 can be spaced apart or overlapped. Alternatively, the quarters could be connected to one another via a gusset.

The boot 1 further includes a first tightening device 30, provided to reversibly reduce the opening. In other words, the tightening device 30 makes it possible to reversibly tighten the upper 3.

As is known to one of ordinary skill in the art, the tightening device 30 includes, for example, a first linkage strand 31, a second linkage strand 32, as well as connections 33, or linkage guides, for connecting the strands to the upper 3 along a linkage zone of the upper 3. Each linkage strand runs from one quarter 15, 16 to the other in the area of the lower subdivision 19, although other lacing patterns are also embraced by the invention. In any event, this arrangement of linkage strands, connections, and boot quarters makes it possible to reversibly tighten the upper 3 toward the instep, in the area of the lower subdivision 19 of the opening 17. Thus, it is possible to apply a tightening force on the foot of the user. The linkage strands can be separate or they can be co-extensive, thereby forming a single linkage or lace. The boot 1 is provided with a quick-locking mechanism 34 in order to keep the device 30, and therefore the upper 3, tightened. Although not described in detail here, the quick-locking mechanism 34, as shown more clearly below, is positioned so as to project from the tongue 20 when the device 30 is tightened. Equally notable is the fact that the quick-locking mechanism also provides quick release of the linkage strands, i.e., it can be also characterized as a quick-release mechanism, for quickly releasing the tension on the linkage strands. U.S. Pat. No. 5,477,593 is incorporated by reference thereto in its entirety as disclosing a suitable exemplary quick-locking mechanism.

In addition, the boot 1 includes a cover flap 35 provided to improve the imperviousness of the boot. In a use configuration of the boot, in which the wearer engages in one of the fields of endeavor mentioned above, the flap 35 covers the tightening device 30, as shown in FIG. 1. More specifically, and in a non-limiting fashion, according to the first embodiment, the flap 35 extends from one quarter 15, 16 to the other in the transverse direction. The flap 35 also extends in the area of the lower portion 10 and in the area of the top portion 11. The flap 35 also covers at least the front surfaces of the lower 10 and top 11 portions, which prevents, or at least significantly reduces, the intrusion of foreign matter into the upper 3. In a non-use configuration of the boot, as shown in FIG. 2, in which the wearer can adjust the tightening of the boot, the flap 35 is folded back to expose elements of the tightening device 30 that are covered by the flap in the use configuration of the boot.

Figure 2:
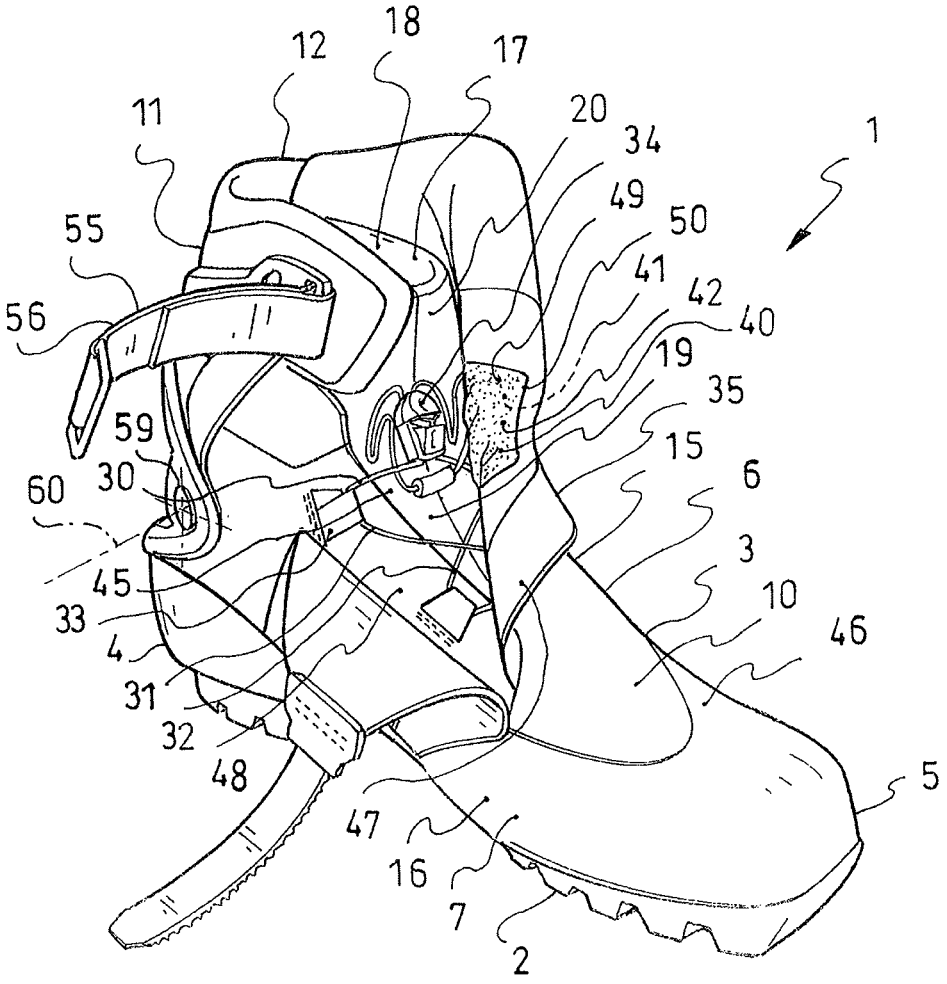
FIG. 2 is a perspective front view of the boot of FIG. 1, with the covering flap of the boot being shown folded back to expose underlying portions of the upper in non-use configuration of the boot.
Figure 3:
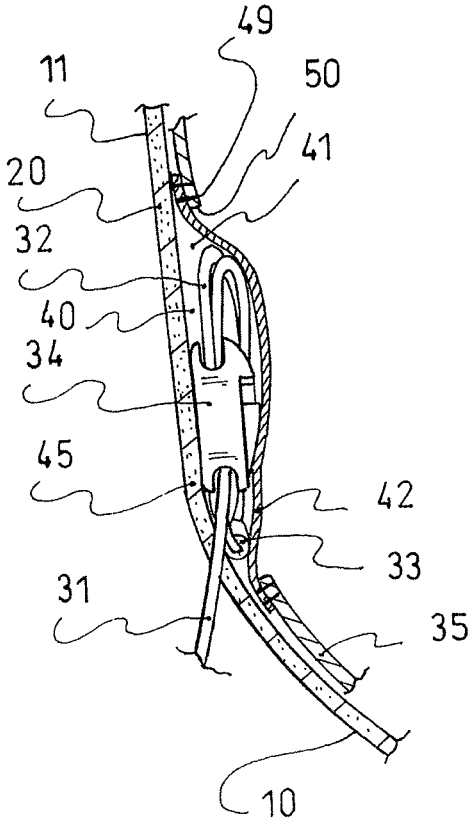
FIG. 3 is a partial cross-section along the line III-III of FIG. 1.

According to the invention, as can be understood from FIGS. 1 to 3, the flap 35 demarcates a storage space 40 structured and arranged to receive the quick-locking mechanism 34. In a non-limiting fashion, the flap 35 has a first opening 41, that is, a through opening, the quick-locking mechanism 34 being positioned in the area of the first opening 41 of the flap when the flap is pressed against the remainder of the upper and when the tightening device 30 tightens the linkage strands 31, 32, and a panel 42 is arranged in the area of the first opening 41 to close the latter by enveloping the locking mechanism 34. In the aforementioned use configuration of the boot, forward of the first opening, the flap covers the linkage strands.

The panel 42 extends around the projection formed by the locking mechanism 34, as mentioned above, so that the flap 35 can uniformly cover the tightening device 30 and subdivisions of the lateral 15 and medial 16 quarters. In fact, the panel 42 here demarcates the storage volume 40 for the locking mechanism. As a result, the flap 35 has uniform curves when it is applied against the quarters 15, 16. In other words, the flap 35 does not form folds. Therefore, it does not oppose, or only very slightly opposes, deformations of the upper 3 related to steering. These are deformations associated, for example, with the bending of the lower leg toward the foot. In fact, the upper 3 retains all or most of the flexibility created during manufacture. As a result, advantageously, the user is not hindered while steering, i.e., such as by applying forces while engaged in any of various activities.

According to the first embodiment of the invention, the first tightening device 30 extends in the area of the lower portion 10 of the upper 3. This enables the upper 3 to be reversibly tightened between the front end 5 and the junction 45 of the lower 10 and top 11 portions. This junction is a concave subdivision of the upper, and it is located opposite the instep and the flexion crease of the upper. Tightening the lower portion 10 maintains the foot supported toward the outer sole assembly 2 for greater steering precision.

In a non-limiting fashion, the first opening 41 of the flap 35 is located at the junction 45 of the lower portion 10 and top portion 11 of the upper 3. Because it is positioned in the area of the first opening 41, the reversible locking mechanism 34 is found at the junction of the lower 10 and top 11 portions during tightening with the first tightening device 30. In fact, the locking mechanism 34, in the opening 41, is positioned so as to be opposite the instep and/or the flexion crease. This also means that the locking mechanism 34 is the element that is farthest retracted, starting at the front end 5, from the tightening device 30. This retracted position, near the leg of the user, makes it easier to manipulate the mechanism. Furthermore, the flap 35 can remain pressed against the lateral 15 and medial 16 quarters when the tightening device 30 tightens the lower portion 10. Therefore, the flap 35 retains its natural shape, which is that of the upper 3, and therefore retains its natural flexibility. It can be said that the presence of the locking mechanism 34 does not interfere with the positioning of the flap 35, due to the first opening 41.

Still according to the first embodiment, the flap 35 is flexible so that it can be applied on the quarters 15, 16, and so that it can be spaced apart and provide greater access to the foot insertion opening 17. The flap 35 is inextensible, in order to promote repetitive positioning. Alternatively, however, the flap could be provided to be extensible.

Due to its inherent shape, the flap 35 is designed to extend opposite the lower portion 10 and opposite the top portion 11 during use of the boot. In fact, the flap extends opposite the lower subdivision 19 of the foot insertion opening 17, and at least partially opposite the lateral 15 and medial 16 quarters, which protects the upper 3 from the intrusion of foreign matter, such as water or snow.

In a non-limiting fashion, the flap 35 has a plurality of subdivisions 46, 47 having various thicknesses and/or flexibilities. This latter characteristic, i.e., flexibility, is the ability to flex. For example, the flap 35 is provided to include a lateral subdivision 46, which is relatively thick or has limited flexibility, as well as a medial subdivision 47, which is relatively thin and, in this case, more flexible than the lateral subdivision 46. As further explained below, the differences in flexibility in the area of the subdivisions 46, 47 increase the ability of the flap 35 to closely conform to the shape of the quarters 15, 16, or to the shape of the lower subdivision 19 of the foot insertion opening 17.

Here, the flap 35 has a second, longitudinal opening 48. This opening enables a transverse clearance of the flap 35 to facilitate access to the first tightening device 30, and also to facilitate the insertion or removal of the foot.

In a non-limiting manner, the second opening 48 of the flap 35 is arranged in the area of the medial portion 7 of the upper 3. This enables the flap 35 to be applied manually on the quarters 15, 16, with the the wearer's hand located on the opposite side to the foot. For example, the flap 35 of a left boot is applied simply by pulling with the right hand. Thus, the medial location of the second opening 48 makes it easy to position the flap. Other arrangements of the opening 48 can be provided. For example, the opening 48 can be oriented so as to form an angle in relation to the longitudinal direction of the boot.

To further facilitate the positioning, and in a non-limiting fashion, the invention provides for the panel 42 associated with the first opening 41 to be reversibly extensible. This panel is made from fabric, for example, comprised of reversible extensible threads, or is manufactured with an elastic layer such as rubber, or the like. As a result, the panel 42 closely conforms to the shape of the locking mechanism 34 when the flap 35 is applied on the quarters 15, 16, and the first device 30 tightens the lower portion 10. In fact, these conditions position the mechanism 34 in the first opening 41. Alternatively, the invention encompasses an embodiment in which the panel 42 associated with the first opening 41 is inextensible. In this case, it would be in the form of a case projecting on the flap 35, in the area of the first opening 41. The case closes the opening 41 at the same time as it houses the locking mechanism 34, still in the context of providing the flap 35 with the ability to conform to the natural shape of the upper 3. In other words, the case demarcates the storage volume.

With reference back to the first embodiment, the invention provides for the panel 42 to close the first opening 41 permanently, which optimizes the imperviousness of the flap 35 by completely locking the penetration of foreign matter into the upper. This protects the foot insertion opening 17 and also preserves the locking mechanism 34.

In a non-limiting fashion, the panel 42 is affixed, for example, by one or more stitches 49, an entirety of the closed periphery 50 of the first opening 41. This makes its positioning quick and simple. Alternatively, other means of fastening, such as an adhesive, nesting, or the like, can be provided.

Moreover, the boot 1 includes a second tightening device 55 located in the area of the top portion 11 of the upper 3. Its role is to complete the tightening of the upper 3, whereas the first device 30 tightens the lower portion 10. In the end, it is the entire upper 3 that can be reversibly tightened. An advantage associated with the two devices 30, 55 is the possibility to tighten or loosen the two portions independently from one another. For example, it is possible to release only the top portion, in order to relieve the lower leg, while preserving foot retention.

In a non-limiting fashion, the second tightening device 55 includes a strap 56, which can be tensioned with more or less force. The strap is kept in position, for example, by means of a lever 57, which provides the second tightening device 55 with a structure that is simple and easy to use.

Still according to the first embodiment, the second portion 11, or top portion, of the upper 3 includes a collar 58 affixed to the remainder of the upper 3 by an articulation 59. The latter is obtained by any suitable structure known to one of ordinary skill in the art, extending along a transverse axis 60 of the boot. This arrangement enables the lower leg to be held transversely in relation to the foot. Consequently, the transverse support forces, related to the steering of a ski, are more precise.

Figure 4:
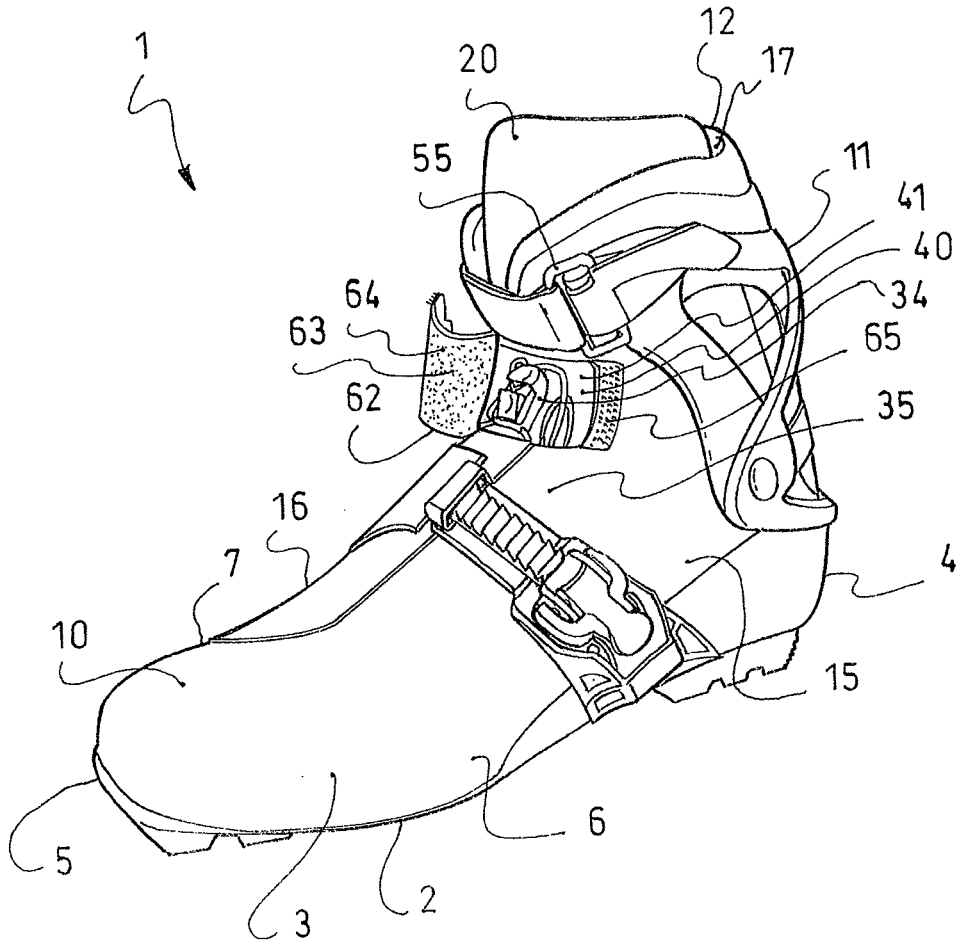
FIG. 4 is a perspective front view of a boot according to a second embodiment of the invention, in which the flap is closed upon the remainder of the upper.

The second embodiment is illustrated below with reference to FIG. 4. For reasons of convenience, the elements shared with the first embodiment are designated by the same reference numerals. Thus, only the differences are highlighted.

Thus, the second embodiment has a boot 1, which includes an outer sole assembly 2 and an upper 3, with a lower portion 10 and a top portion 11. The boot further includes a flap 35 having a first opening 41 for a locking mechanism 34.

Specific to the second embodiment is that the opening 41 can be closed or open independently of the position of the flap 35. To this end, the boot 1 includes a panel 62 which closes the first opening 41 intermittently. The panel 62 is comprised of a flexible element, for example, made of fabric, leather, or any equivalent material. The panel 62 is affixed to the flap 35 in the manner of a door, which allows opening or closing the opening 41. The boot 1 includes a removable hook-and-loop closure mechanism 63 made, for example, with two fabric parts, a first part 64 being covered with loops and a second part 65 covered with hooks. One of the parts of the closure mechanism is affixed to the flap 35, whereas the other is affixed to the panel 62. This embodiment allows direct access to the locking mechanism 34, if necessary, without separation of the flap 35.

The boot of the invention is made from materials and using techniques of implementation known to one of ordinary skill in the art.

The invention is not limited to the embodiments described above, and includes all technical equivalents that fall within the scope of the claims that follow.

In particular, the first opening 41 can be located elsewhere than at the junction of the low 10 and top 11 portions.

In addition to the foregoing, the invention disclosed herein by way of exemplary embodiments suitably may be practiced in the absence of any element or structure which is not specifically disclosed herein.

The invention claimed is:

1. A boot comprising:
an outer sole assembly;
an upper extending upwardly beyond the sole assembly;
a length extending in a longitudinal direction between a heel and a tip, a width extending transversely between a lateral portion and a medial portion, and a height extending between the outer sole assembly and an upper end of the upper;
the upper comprising a lateral quarter and a medial quarter;
a first tightening device comprising a linkage, a plurality of linkage guides, and a quick-locking mechanism;
a cover flap extending over the linkage and over the plurality of linkage guides in a use configuration of the boot;
the cover flap demarcating a storage space designed to receive the quick-locking mechanism;
the cover flap having a first opening, the quick-locking mechanism being positioned in the area of the first opening of the flap when the tightening device tightens the linkage; and
a panel arranged in the area of the first opening for closing the first opening and enveloping the locking mechanism.

2. A boot according to claim 1, wherein:
the upper includes a lower portion and a top portion; and
the first tightening device extends in the area of the lower portion of the upper.

3. A boot according to claim 2, wherein:
the first opening of the flap is located at a junction of the lower portion and the top portion of the upper.

4. A boot according to claim 1, wherein:
the flap is comprised of a material that is inextensible.

5. A boot according to claim 2, wherein:
during use of the boot, the flap extends opposite the lower portion and opposite the top portion of the upper.

6. A boot according to claim 1, wherein:
the flap has a plurality of subdivisions of different thickness and/or flexibility.

7. A boot according to claim 1, wherein:
the flap has a second, longitudinal opening.

8. A boot according to claim 7, wherein:
the second opening is arranged in the area of the medial portion.

9. A boot according to claim 1, wherein:
the panel associated with the first opening is comprised of a material that is reversibly extensible.

10. A boot according to claim 1, wherein:
the panel associated with the first opening is comprised of a material that is inextensible.

11. A boot according to claim 1, wherein:
the panel is permanently fixed to the flap along an entirety of a closed periphery of the first opening to permanently close the first opening.

12. A boot according to claim 1, wherein:
the panel is fixed to the flap so as not to permanently close the first opening and to allow intermittent access to the opening.

13. A boot according to claim 2, further comprising:
a second tightening device located in the area of the top portion of the upper.

14. A boot according to claim 13, wherein:
the second tightening device comprises a strap.

15. A boot according to claim 2, wherein:
the second portion of the upper comprises a collar affixed to a remainder of the upper by an articulation.

16. A boot according to claim 1, wherein:
the cover flap is positioned over the lateral quarter and over the medial quarter of the upper.

17. A boot according to claim 1, further comprising:
a tongue extending beneath and between the lateral quarter and the medial quarter of the upper;
the plurality of linkage guides designed to guide the linkage between the lateral quarter and the medial quarter; and
the cover flap being positioned over the tongue.

18. A boot according to claim 1, wherein:
the boot has no tongue between the lateral and medial quarters.

19. A boot comprising:
an outer sole assembly;
an upper extending upwardly beyond the sole assembly;
a length extending in a longitudinal direction between a heel and a tip, a width extending transversely between a lateral portion and a medial portion, and a height extending between the outer sole assembly and an upper end of the upper;
the upper comprising a lateral quarter and a medial quarter;
a first tightening device comprising a linkage and a quick-locking mechanism;
a cover flap demarcating a storage space structured and arranged to receive the quick-locking mechanism;
the cover flap comprising:

a first opening, the quick-locking mechanism being positioned in the area of the first opening of the flap when the tightening device tightens the linkage; and a second, longitudinal opening; and a panel arranged in the area of the first opening for closing the first opening and enveloping the locking mechanism.

20. A boot according to claim 19, wherein:

the second opening is arranged in the area of the medial portion.

21. A boot according to claim 19, wherein:

the panel is permanently fixed to the flap along an entirety of a closed periphery of the first opening to permanently close the first opening to access to the quick-locking mechanism through the cover flap.

22. A boot comprising:

an outer sole assembly;

an upper extending upwardly beyond the sole assembly;

a length extending in a longitudinal direction between a heel and a tip, a width extending transversely between a lateral portion and a medial portion, and a height extending between the outer sole assembly and an upper end of the upper;

the upper comprising a lateral quarter and a medial quarter;

a first tightening device comprising a linkage defining a longitudinally extending linkage zone and a quick-locking mechanism;

a cover flap demarcating a storage space designed to receive the quick-locking mechanism;

the cover flap having a through opening extending through the cover flap, the through opening being defined by a closed periphery;

a panel completely closing the opening against access through the cover flap; and the quick-locking mechanism being positioned beneath the panel and being enveloped by the panel when the tightening device tightens the linkage.

23. A boot according to claim 22, wherein:

the cover flap extends forwardly at least to a front end of the linkage zone.

* * * * *